US008911671B2

(12) United States Patent
Chen

(10) Patent No.: US 8,911,671 B2
(45) Date of Patent: Dec. 16, 2014

(54) ELECTRONIC INCENSE AND ELECTRONIC BURNING USING SAME

(75) Inventor: Po-Chou Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 282 days.

(21) Appl. No.: 13/613,238

(22) Filed: Sep. 13, 2012

(65) Prior Publication Data

US 2013/0163275 A1 Jun. 27, 2013

(51) Int. Cl.
*A62B 7/08* (2006.01)

(52) U.S. Cl.
USPC ..... 422/123; 422/120

(58) Field of Classification Search
USPC ..... 422/120, 123
See application file for complete search history.

(56) References Cited

U.S. PATENT DOCUMENTS 6,635,832 B1 * 10/2003 Oster et al. ..... 200/6 A
2007/0122076 A1 * 5/2007 Ishiyama et al. ..... 385/19
2010/0260646 A1 * 10/2010 Jorgensen ..... 422/125

* cited by examiner

*Primary Examiner* — Regina M Yoo
(74) *Attorney, Agent, or Firm* — Novak Druce Connolly Bove + Quigg LLP

(57) ABSTRACT

An electronic burner includes a burner base and an electronic incense. The burner base includes a burner body and a light emitting source mounted in the burner body. Then electronic incense includes a light guiding body and an incense head. The light guiding body is detachably mounted with the burner body. The incense head includes a first chamber, a second chamber, first reaction solution, and second solution. The first chamber is connected with the light guiding body away from the burner body. The second chamber is received in the first chamber. The first reaction solution received in the first chamber, and the second solution is received in the second chamber. When the second chamber is cracked, the first reaction solution and the second reaction solution would be mixed together in the first chamber to make a chemistry reaction happen, and at the same time, produce light.

11 Claims, 2 Drawing Sheets

ELECTRONIC INCENSE AND ELECTRONIC BURNING USING SAME

BACKGROUND

1. Technical Field

The present disclosure generally relates to burners, and particularly to an electronic burner and an electronic incense.

2. Description of Related Art

Common electronic burner for burning incense at a sacrificial offering for example, includes a burner base, an electronic socket received in the burner base, and an electronic incense positioned in the burner base. A light emitting source is positioned in the burner base under the electronic socket. The electronic incense includes a light guiding body and an incense head fixed on a distal end of the light guiding body away from the burner base. In use, the other end of the light guiding body is inserted into the electronic socket and corresponds to the light emitting source. When the electronic socket is electrically connected with an external power source, light emitted by the light emitting source is transferred to the incense head via the light guiding body for simulating the real incense burning. However, the electronic incense should be used together with the burn base and the electronic socket for emitting power.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
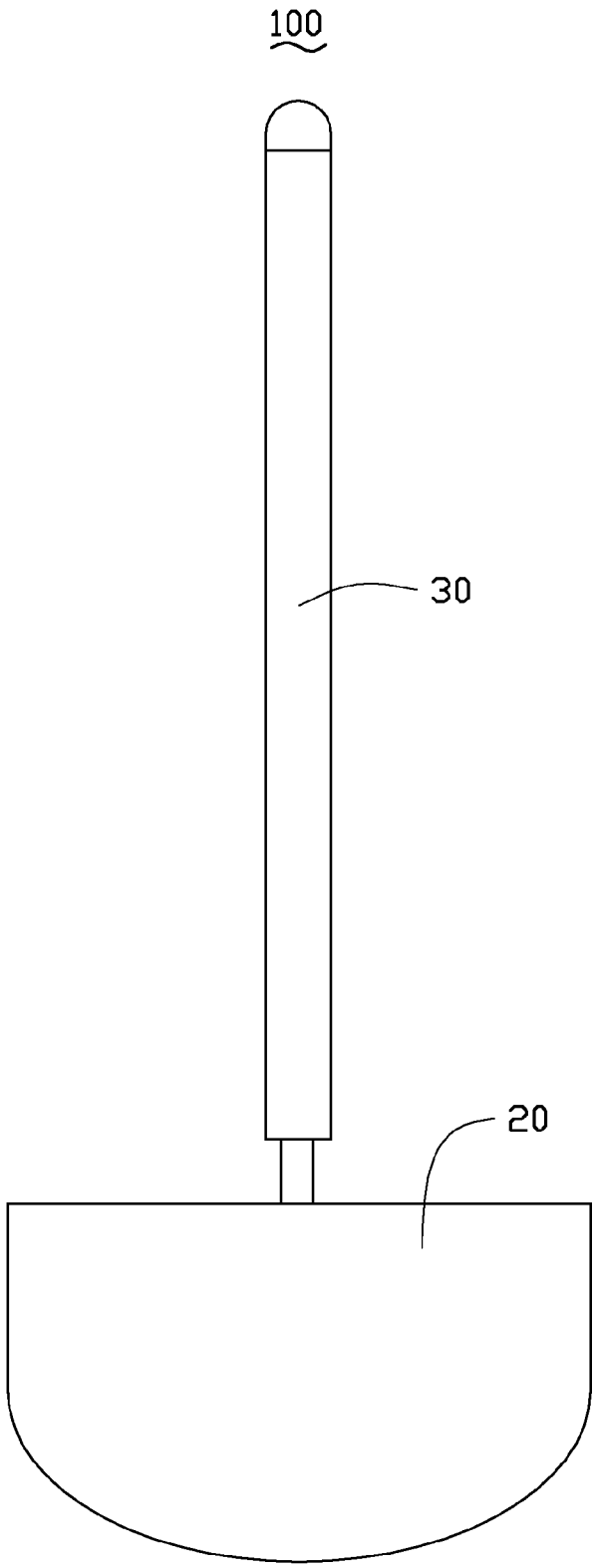
FIG. 1 shows a side view of an embodiment of an electronic burner.

Referring to FIG. 1, an embodiment of an electronic burner 100 is shown. The electronic burner 100 includes a burner base 20 and an electronic incense 30 detachably inserted into the burner base 20.

Figure 2:
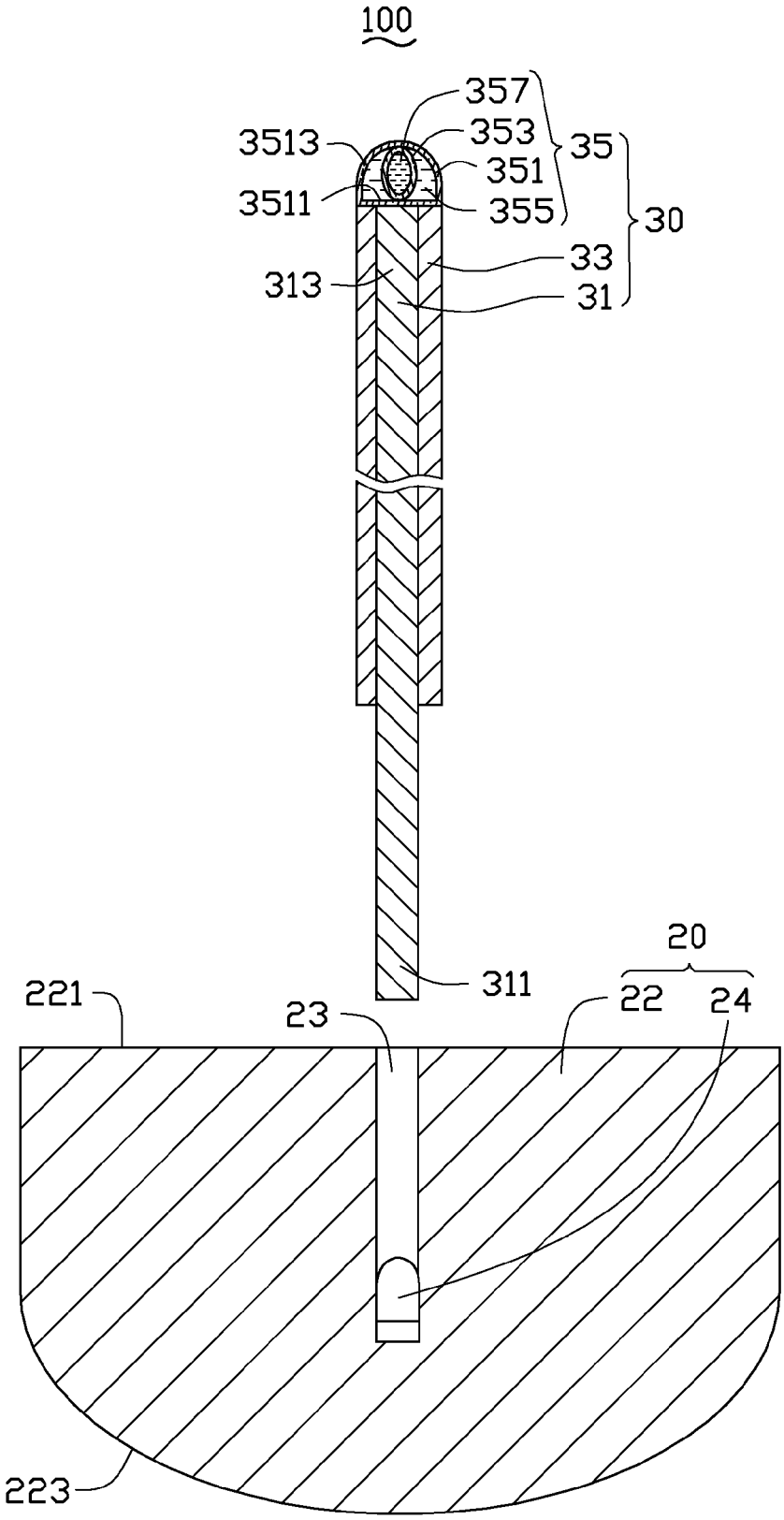
FIG. 2 shows a sectional side view of the electronic burner of FIG. 1.

Also referring to FIG. 2, a shape of the burner base 20 is designed to be similar to real burners. The burner base 20 includes a burner body 22 and a light emitting source 24 mounted in the burner body 22. In the illustrated embodiment, the burner body 22 is a solid structure. The burner body 22 includes a top surface 221 and a bottom surface 223 positioned opposite to the top surface 221. A columnar insertion groove 23 is defined on the top surface 221 toward the bottom surface 223 for inserting the electronic incense 30. The light emitting source 24 is received in a bottom of the insertion groove 23. The light emitting source 24 is an independent and changeable light emitting diode. In other embodiments, the light emitting source 24 maybe a light source electrically connected with the external power for use, or a light source can be power charged; the burner body 22 maybe a hollow structure, then an insertion member or a socket (not shown) is positioned in the burner body 22 for the electronic incense 30.

The electronic incense 30 is detachably inserted into the insertion groove 23 and above of the light emitting source 24. The electronic incense 30 is a column. The electronic incense 30 includes a light guiding body 31, a coating layer 33 and an incense head 35. The light guiding body 31 is a transparent column for guiding the light emitted by the light emitting source 24 to the incense head 35. The light guiding body 31 includes an insertion end 311 and a connecting end 313 positioned opposite to the insertion end 311. The insertion end 311 is engaged with the insertion groove 23. The connecting end 313 is connected with the incense head 35. In the illustrated embodiment, the light guiding body 31 is made of transparent material, such as transparent glass, or one or more transparent resins selected from the group including polyacrylic acid (PAA), polycarbonate (PC), polystyrene (PS), polymethyl methacrylate (PMMA), and methyl methacrylate and styrene (MS). The coating layer 33 fits over the light guiding body 31 to stop light escaping from the light guiding body 11 and scattering. Two end surfaces of the light guiding body are exposed out of the coating layer 33. The insertion end 311 is also exposed out of the coating layer 33. The light guiding body 31 maybe designed to be a solid rod or a hollow pipe.

The electronic incense head 35 is connected with the connecting end 313 away from the insertion end 311 for receiving light emitted by the light emitting source 23. The incense head 35 is transparent. The incense head 35 includes a first chamber 351, a second chamber 353, first reaction solution 355, and a second reaction solution 357. The first chamber 351 is connected with the connecting end 313 away from the insertion end 311. The first chamber 351 is a transparent, hollow and close half ball. The first chamber 351 is made of polyethylene. The hollow portion of the first chamber 351 is the reaction chamber 3513 for receiving the first reaction solution 355 and the second chamber 353. The second chamber 353 is a hollow, transparent and close ellipsoid for receiving the second reaction solution 357. The second chamber 353 is made of fragile materials, such as glass. The first reaction solution 355 is received in the first chamber 351. The first reaction solution 355 is solution of fluorescent dye mixed with the oxalic acid phenyl ester derivatives. Color of the fluorescent dye can be chosen by real application. The second reaction solution 357 is received in the second chamber 353. The second reaction solution 357 is hydrogen peroxide solution.

A fluorescent reaction will happen when the first reaction solution 355, and the second reaction solution is mixed. Fluorescence is produced during the fluorescent reaction. In other embodiments, shapes of the first chamber 351 and second chamber 353 can be designed in other shapes, such as cubic, for example. The first reaction solution 355 maybe hydrogen peroxide solution and the second reaction solution 357 maybe fluorescent dye solution.

When the electronic incense 300 is used with the burner base 20 the insertion end 311 is inserted into the insertion groove 23. Light will emit from the light emitting source 24 after triggering. Light is transferred via the light guiding body 31 and enters the incense head 35. Then the incense head 35 emits light. If the users want use the electronic incense 30 alone. The second chamber 353 is firstly cracked by external force. Then the second reaction solution 357 enters the reaction chamber 3513 and mixes with the first reaction solution 355. A fluorescent reaction happens. The lipids of the first reaction solution 355 are oxidized and release energy at the same time. The fluorescent dye stays in the excited state and emits fluorescence.

The electronic incense 30 will emit fluorescence when the second chamber 353 is cracked by the external force because of fluorescent reaction. Therefore, the electronic incense 30 is capable of simulating real incense emitting light and may be used alone. when the electronic incense 30 is used together with the burner base 20, the fluorescence emitted by the electronic incense 30 will strength the light emitted by the light emitting source 24. Then the effect of light will be more authentic and beautiful.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. An electronic burner, comprising:

a burner base comprising a burner body and a light emitting source mounted in the burner body; and an electronic incense comprising:

a light guiding body detachably mounted with the burner body at one distal end thereof;

an incense head comprising a first chamber connected with the end of the light guiding body away from the burner body, a second chamber received in the first chamber, a first reaction solution received in the first chamber, and a second solution received in the second chamber, wherein when the second chamber is cracked, the first reaction solution and the second reaction solution would be mixed together in the first chamber to make a chemistry reaction happen, and, at the same time, produce light.

2. The electronic burner of claim 1, wherein the first reaction solution is solution of fluorescent dye mixed with oxalic acid phenyl ester derivatives.

3. The electronic burner of claim 2, wherein the second reaction solution is hydrogen peroxide solution.

4. The electronic burner of claim 1, wherein the second chamber is made of glass.

5. The electronic burner of claim 1, wherein the electronic incense further comprises a coating layer, the coating layer fits over the light guiding body, and two end surfaces of the light guiding body expose out from the coating layer.

6. The electronic burner of claim 1, wherein the burner body comprises a top surface and a bottom surface positioned oppositely to the top surface, an insertion groove is defined on the top surface toward the bottom surface, the light guiding body is positioned in the insertion groove.

7. An electronic incense comprising:

a light guiding body;

an incense head comprising a first chamber connected with one end of the light guiding body, a second chamber received in the first chamber, a first reaction solution received in the first chamber, and a second solution received in the second chamber, wherein when the second chamber is cracked, the first reaction solution and the second reaction solution would be mixed together in the first chamber to make a chemistry reaction happen, and, at the same time, produce light.

8. The electronic incense of claim 7, wherein the first reaction solution is solution of fluorescent dye mixed with oxalic acid phenyl ester derivatives.

9. The electronic incense of claim 8, wherein the second reaction solution is hydrogen peroxide solution.

10. The electronic incense of claim 7, wherein the second chamber is made of glass.

11. The electronic incense of claim 7, wherein the electronic incense further comprises a coating layer, the coating layer fits over the light guiding body, and two end surfaces of the light guiding body expose out from the coating layer.

* * * * *